United States Patent [19]

Matsui et al.

[11] Patent Number: 4,723,720

[45] Date of Patent: Feb. 9, 1988

[54] YARN END FINDING DEVICE

[75] Inventors: Isamu Matsui, Kyoto; Shuzo Kawamura, Joyo, both of Japan

[73] Assignee: Murata Kikai Kabushiki Kaisha, Kyoto, Japan

[21] Appl. No.: 864,586

[22] Filed: May 16, 1986

[30] Foreign Application Priority Data

May 22, 1985 [JP] Japan ..... 60-111123

[51] Int. Cl.[4] ..... B65H 54/20; B65H 54/22

[52] U.S. Cl. ..... 242/18 R; 242/35.5 A; 242/35.6 R; 242/35.6 E

[58] Field of Search ..... 242/35.6 E, 35.6 R, 242/35.5 R, 35.5 A, 18 R

[56] References Cited

U.S. PATENT DOCUMENTS

| | | | |
|---|---|---|---|
| 2,675,971 | 4/1954 | Abbott | 242/35.6 R |
| 3,471,101 | 10/1969 | Moyer et al. | 242/35.6 R |
| 3,544,018 | 12/1970 | Stoppard et al. | 242/35.6 R |
| 3,563,478 | 2/1971 | Bell | 242/35.6 R |
| 3,652,025 | 3/1972 | DiMauro | 242/35.6 E X |
| 3,754,718 | 8/1973 | Abbott | 242/35.6 R |
| 4,544,107 | 10/1985 | Matsui et al. | 242/35.5 A |
| 4,613,091 | 9/1986 | Kirake | 242/35.5 A |
| 4,616,789 | 10/1986 | Matsui et al. | 242/35.6 R X |

*Primary Examiner*—Stanley N. Gilreath
*Attorney, Agent, or Firm*—Spensley Horn Jubas & Lubitz

[57] ABSTRACT

A yarn end finding device in which a yarn end suction opening part of a suction mouth for leading out a yarn end on a surface of a yarn layer on a spinning bobbin by an action of a suction air flow can be moved on the basis of the difference in the yarn layer diameter of the spinning bobbins to be treated.

14 Claims, 7 Drawing Figures

YARN END FINDING DEVICE

FIELD OF THE INVENTION AND RELATED ART STATEMENT

The present invention relates to a yarn end finding device for a spinning bobbin produced by a spinning frame.

In a spinning bobbin produced by a spinning frame, particularly a ring spinning frame, a bunch winding is provided at an end part of a take-up tube provided in the center of the bobbin, and when the bobbin is supplied to an automatic winder for a rewinding step, the bobbin is supplied in the state wherein the bunch winding is unwound. For this purpose, a yarn end finding device is provided in the vicinity of the winder.

As such a yarn end finding device, in general, a yarn end finding member utilizing a suction airflow which is called "suction mouth" is used. Namely, a suction airflow generated through the suction mouth is made to act on the surface of the yarn layer on the bobbin to such a yarn end present on the surface of the yarn layer, thereby picking up the yarn end.

Where the number of kinds of the spinning bobbins to be treated is small and the number of the bobbins in each lot is large, the yarn end finding operation can be performed, without troubles, by simply positioning the bobbin to a predetermined position proximate to the suction mouth disposed at a fixed position. However, in a multiple-kind small-volume production system and, further, where the kinds of the bobbins fed are random, the spacing between the opening part of the suction mouth and the surface of the yarn layer on the bobbin varies depending on the diameter of the yarn layer, so that the suction force acting on the surface varies, causing a mis-finding.

OBJECT AND SUMMARY OF THE INVENTION

It is an object of the present invention to propose a yarn end finding device in which a yarn end suction opening part of a suction mouth for leading out a yarn end on a surface of a yarn layer on a bobbin by an action of a suction airflow can be moved on the basis of the difference in the yarn layer diameter of bobbins to be treated.

The present invention provide a device comprising a suction mouth movable toward and away from the surface of a yarn layer on a spinning bobbin fed on a fixed feeding passage, means for moving the suction mouth, and means for detecting directly or indirectly the diameter of the yarn layer from which a yarn end is to be picked up, wherein the position of an opening of the suction mouth is changed according to the diameter of the yarn layer.

DETAILED DESCRIPTION OF PREFERRED EMBODIMENTS

Figure 1:
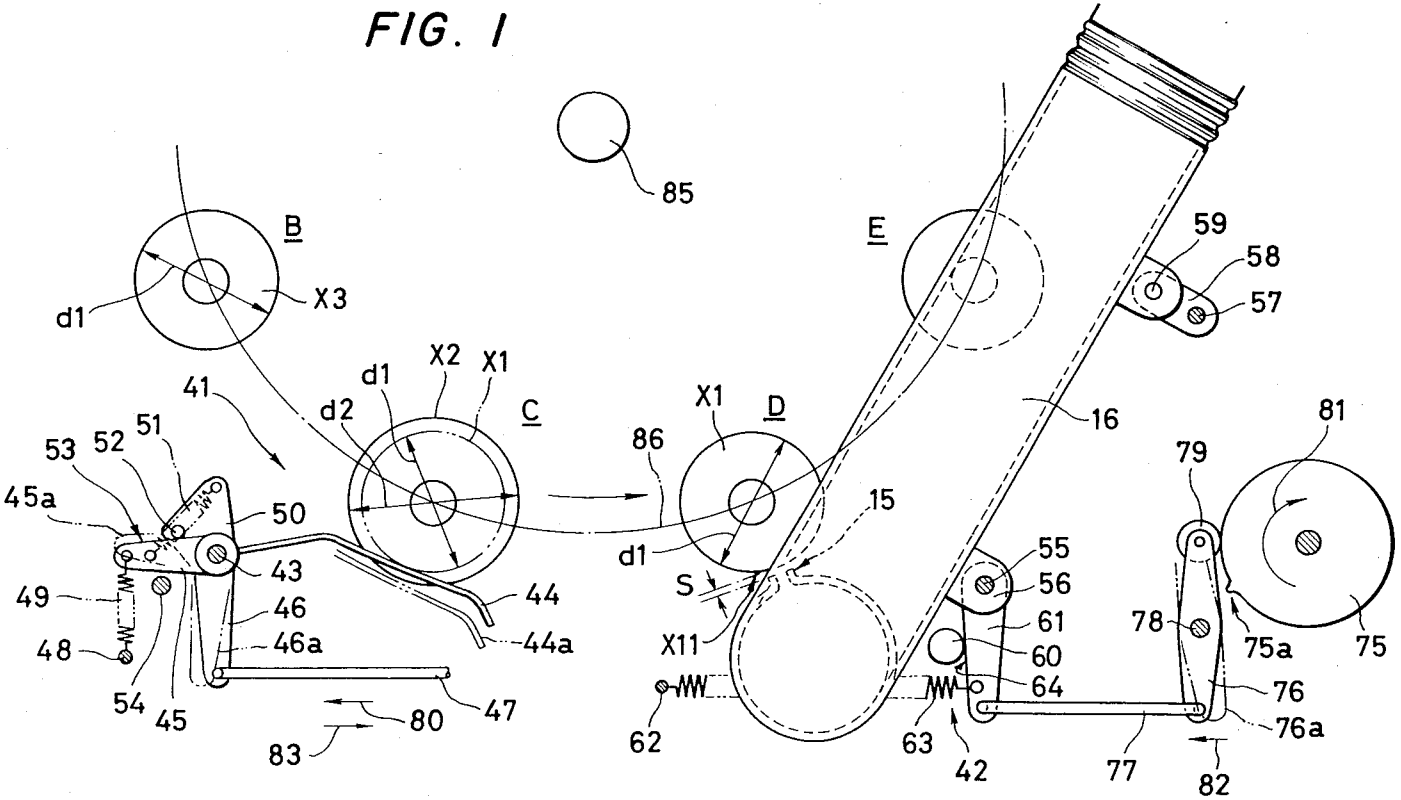
FIG. 1 is a plan view showing an embodiment of the device according to the present invention.

An embodiment of the present invention will now be explained below while referring to the drawings.

Although the following description is made on a finding device for finding a yarn end from a yarn layer by unwinding and cutting a bunch winding in the condition wherein a bobbin is erected on an independent feeding medium (hereinafter, referred to as "tray"), it is natural that the present invention can be also applied to other feeding and finding systems.

Figure 4:
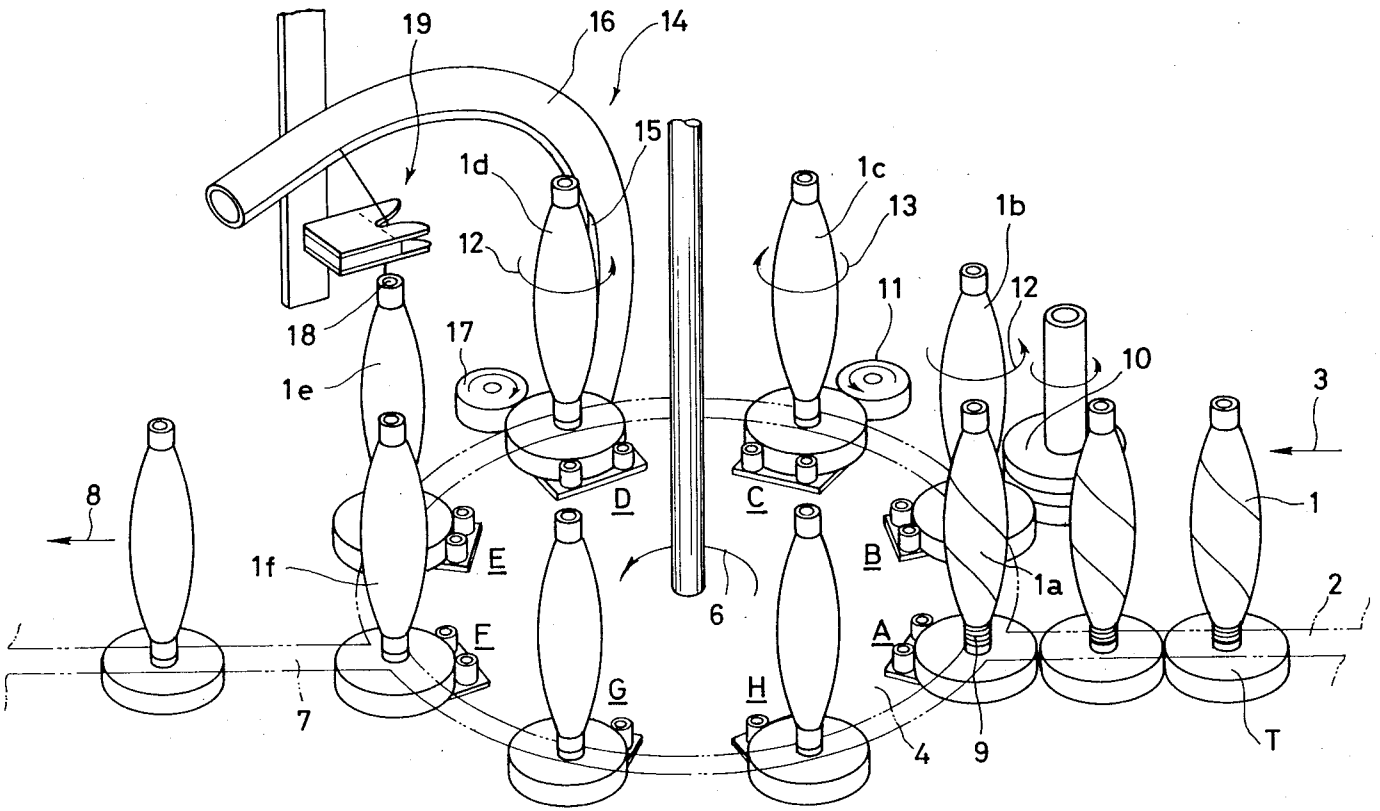
FIG. 4 is a general constructional perspective view showing an example of the yarn end finding.

FIG. 4 shows an example of the finding device.

Although a finding device for the case where the bunch winding is provided at a lower part of each bobbin is shown in the present embodiment, the present invention can also be applied to a case where each bobbin has a top bunch.

Figure 5:
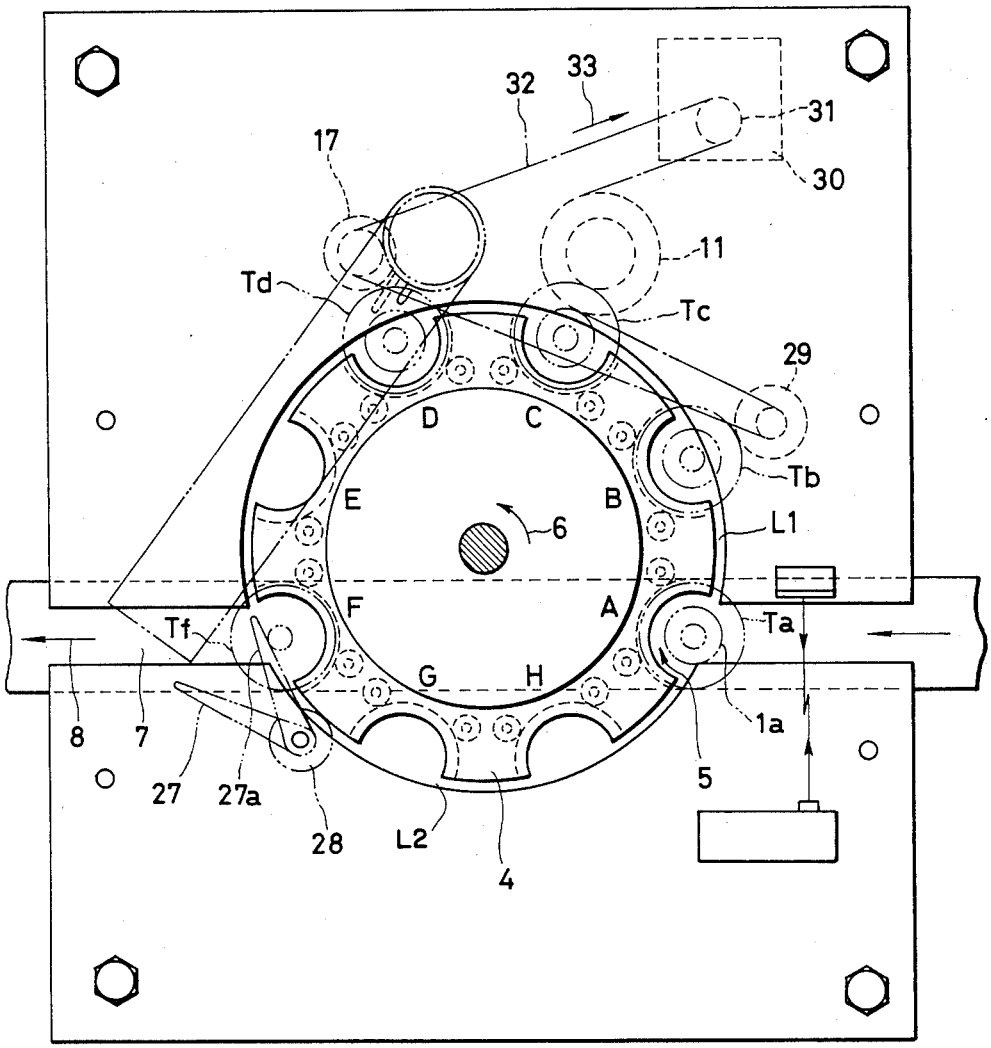
FIG. 5 is a plan view of the same device.

In FIGS. 4 and 5, there is shown a general mechanism of the finding device. The bobbin 1 finished in a fine spinning step is fed along a feeding passage 2 in the direction of arrow 3 in the state of being erected on a tray T, and reaches a receiving position A of the finding device. As a rotary plate 4 of the finding device is intermittently rotated in the direction of arrow 6, the bobbin 1*a* received into tray-receiving parts 5 provided in the rotary plate 4 at fixed-pitch intervals is fed through treating stations B, C, D and E to a delivery station F, where the bobbin 1*f* for which the yarn end finding operation has been successful is fed along a feeding passage 7 in the direction of arrow 8 toward a winder.

At the station B is provided a cutter 10 for unwinding and cutting the bunch winding 9 provided at a lower end part of the bobbin, and at the station C is provided a roller 11 for leading out the yarn extending between the bobbin 1*c* and the cutter 10 and for lightly winding the yarn around the surface of the yarn layer. At the station B, the bobbin 1*b* is rotated by a friction roller in the direction 12 of unwinding the yarn wound thereon, and at the station C the bobbin is rotated by the roller 11 in the direction 13 of winding the yarn. Further, at the station D is provided a yarn end finding device 14 for sucking and unwinding the yarn end being in a free state. The device 14 is constituted of, for instance, a suction mouth 16 having a yarn end suction opening part 15 in the form of a slit. At this position, the bobbin 1*d* is rotated by a friction roller 17 in the direction 12 of unwinding the yarn. Further, at the station E is provided a yarn end inserting mechanism 19 for cutting the yarn led out of the bobbin to a predetermined length and for inserting the yarn end into a central hole 18 of the bobbin 1*e*.

Figure 7:
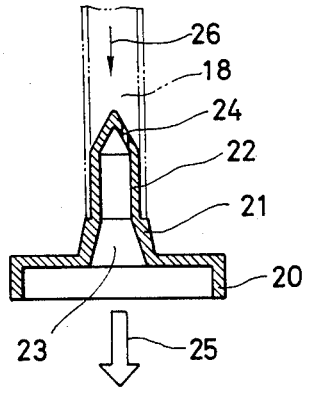
FIG. 7 is a cross-sectional view showing an example of the bobbin feeding medium.

As shown in FIG. 7, the bobbin tray T used in this working example comprises a mount part 21 and a bobbin erecting peg 22 provided as one body on a circular disk form base body 20, and is provided therein with a hollow part 23 opening at the bottom surface. The peg 22 is provided with an air passage hole 24, and when a suction airflow in the direction of arrow 25 is made to act on the interior of the tray T, a suction force 26 is induced in the central hole 18 of the bobbin through the air passage hole 24.

FIG. 5 shows a plan view of the bobbin treating stations. The tray Ta with a bobbin erected thereon reaching a receiving position A is fed through the treating stations B–E along a passage L1 by the intermittent rotation, 45° at a time, of the rotary plate 4 in the direction of arrow 6. Then, at the delivery position F, the bobbin for which the yarn end finding operation has been successful is discharged into the feeding passage 7, while the bobbin for which the finding operation has been unsuccessful is blocked by a movable guide 27, and is subsequently fed again to the receiving position A for the finding operation through a feed-back passage L2, followed by the same operations as above. Namely, a sensor for detecting the yarn end picked up is provided at the treating station E, and when the absence of the yarn end is detected by the sensor, a movable guide 27 shown in FIG. 5 is positioned at a position 27*a* by a rotary solenoid 28 or the like, whereby the discharge of the tray Tf reaching the position F is blocked.

FIG. 5 further shows rollers 29, 11 and 17 and a drive source 30 for rotating the bobbins at respective positions of the treating stations B, C and D. A loop form belt 32 is fitted between an output pulley 31 for a motor 30 and each of the rollers 29, 11 and 17, and when the belt 32 is rotatorily moved in the direction of arrow 33, the rollers 29, 11 and 17 are rotated in predetermined respective directions. The rollers 29, 17 rotate the trays Tb, Td in the direction of unwinding the yarn wound on the bobbin, by making contact with the trays, while the roller 11 rotates the tray Tc in the direction of winding the yarn.

Figure 6:
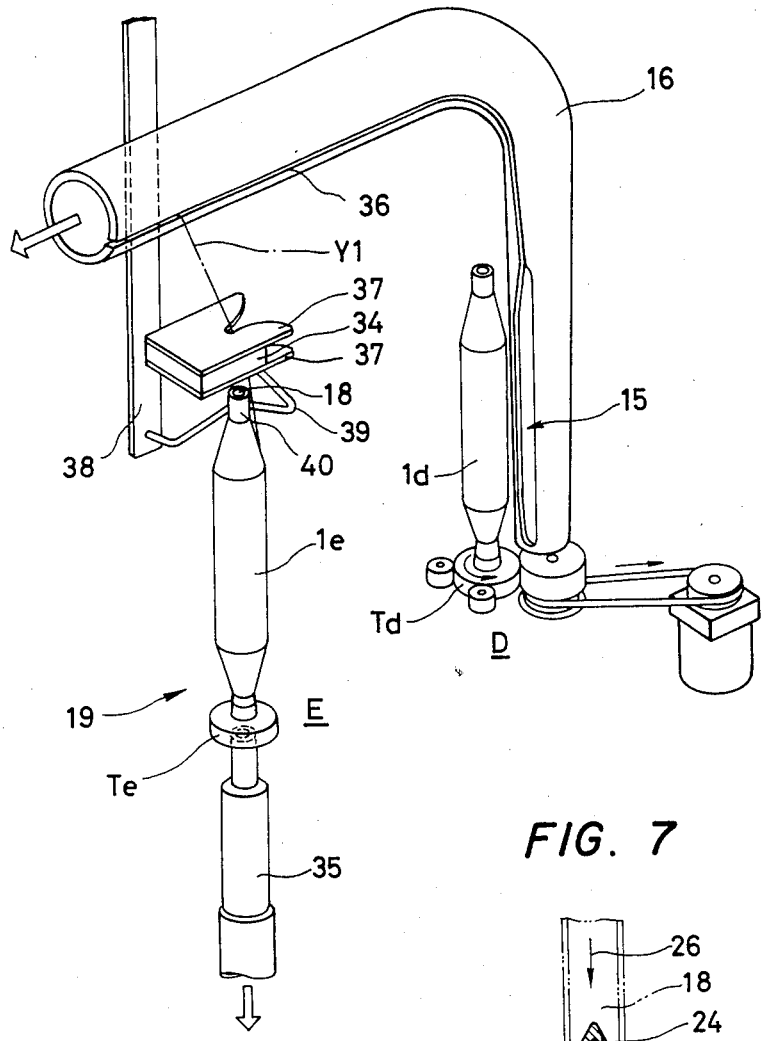
FIG. 6 is a perspective view showing the relationship between the yarn end finding station and the yarn end inserting mechanism.

Referring to FIG. 6, explanation is made on a device for setting the picked-up yarn end to a predetermined position of the bobbin. In this embodiment, a type is illustrated in which the bobbin is fed with the unwound yarn end inserted in the central hole 18 of the bobbin from above.

Namely, the abovementioned yarn end inserting device is provided over the range of the treating stations D and E. The inserting device comprises the suction mouth 16 provided at the station D, the cutter 34 provided at the station E so as to detect the presence or absence of the yarn led out and to cut the yarn at a fixed-length position, a yarn end sucking mechanism 35 for sucking the end of the yarn thus cut into the central hole 18 of the bobbin, etc.

The suction mouth 16 consists of a generally L-shaped suction pipe provided with a slit form opening part 15 extending over the length of the yarn layer of the bobbin at the position of the station D and a slit 36 continuous with the opening part 15 and extending over the combined yarn detector and cutter 34 at the position of the station E. By a mechanism which will be described later, the opening part can be moved toward and away from the surface of the yarn layer, and even where the bobbins to be treated have different yarn layer diameters, the spacing between the surface of the yarn layer and the opening part 15 is automatically adjusted, thereby enabling a constantly fixed suction force to act on the surface on the yarn layer. The pipe 16 is connected to a suction blower (not shown).

At the station E, above the bobbin 1*e* located at the treating position, guide plates 37, 37 are provided for guiding the yarn Y1 extending between the bobbin 1*e* and the slit 36 of the suction mouth 16 to the combined yarn detector and cutter 34, the guide plates being provided as one body with the cutter 34 on a fixed support member 38. Numeral 39 denotes a guide member by which a head part 40 of the bobbin being fed is guided to and positioned at a fixed position and which is fixed to the support member 38.

Figure 2:
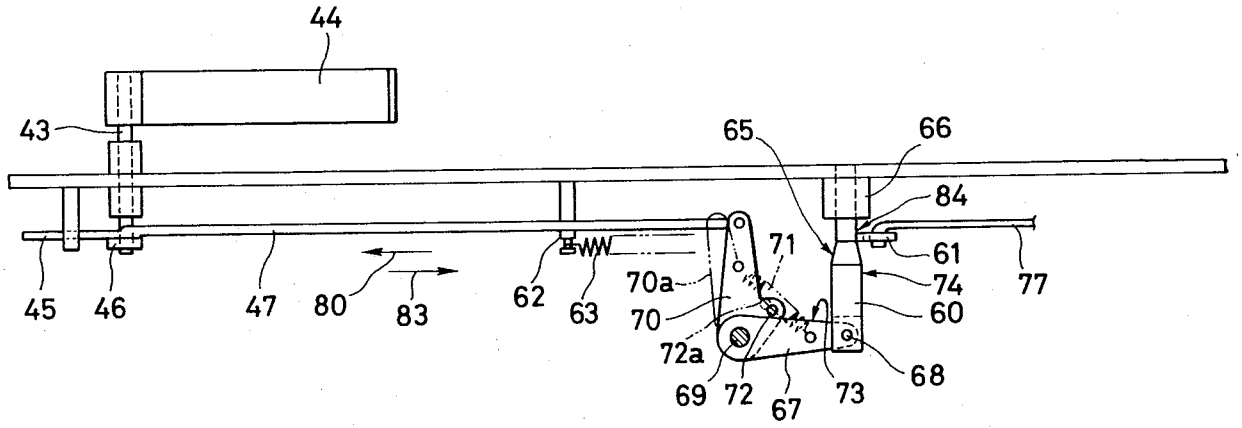
FIG. 2 is a view showing a general construction of means for moving the suction mouth in accordance with the diameter of a yarn layer.

Next, an example of a position controlling mechanism for the suction mouth 16 is shown in FIGS. 1 and 2. The position controlling mechanism comprises a bobbin diameter detecting means 41 for detecting the diameter d1 of the yarn layer on the bobbin X1 located at the station C on the upstream side of the yarn end finding station D, a variable stopper mechanism 42 for the suction mouth 16 which is displaced on the basis of the detecting means 41, etc.

The bobbin diameter detecting means 41 comprises a plate form feeler 44 fixed to a vertical shaft 43, a lever 45 fixed to a lower end part of the shaft 43, and a lever 46 and a rod 47 connected thereto which serve to transmit a moving amount for the suction mouth, based on the displacement of the feeler 44, to the side of the station D. The lever 45, which is turned as one body with the feeler 44 through the shaft 43, is connected with a fixed shaft 48 through a spring 49, whereby the feeler 44 is urged toward the bobbin X1. Further, the other lever 46 is rotatably loosely fitted to the shaft 43, an end part 50 on the side opposite to the side of connection with the rod 47 is connected to the lever 45 through a spring 51, and a stop pin 52 provided on the lever 50 is fastened to a side edge 53 of the lever 45; normally, the lever 46 is turned following up the lever 45. Numeral 54 denotes a stopper for the lever 45. Incidentally, the tensile force f1 of the spring 51 and the tensile force F1 of the spring 49 are so set that $F1 > f1$.

On the other hand, at the station D, the suction mouth 16 is movably supported by a vertical shaft 55 through a bracket 56, and is connected to another vertical shaft 57 through a lever 58 by a pin 59, so that the suction mouth 16 can be moved around the shafts 55 and 57. The opening part 15 of the suction mouth 16 is disposed close to the surface X11 of the yarn layer on the bobbin X1 located at the position D, with a spacing S between the surface X11 and the opening part 15. Namely, the spacing S is controlled by a movable stopper 60. A lever 61 is fixed to a lower part of the vertical shaft 55, a spring 63 is fitted between the lever 61 and a fixed pin 62, and the suction mouth 16 is constantly urged toward the surface of the yarn layer through the lever 61, the position of the suction mouth 16 being determined by the contact of a side edge 64 of the lever 61 with the movable stopper 60. Therefore, the position of the opening part 15 is changed by changing the position of contact of the lever 61 with the stopper in accordance with the bobbin diameter.

As shown in FIG. 2, the stopper 60 has a tapered surface 65 at its intermediate part, and is connected to an end part of a lever 67 by a pin 68 so that it can be moved vertically in a slide guide 66. The lever 67 is pivotally supported by a horizontal shaft 69, on which another lever 70 is also pivotally supported, the levers 67 and 70 are connected with each other by a tension spring 71, and a stopper pin 72 on the lever 70 is fastened to a side edge 73 of the lever 67, so that the levers 67 and 70 can be turned as one body, or, in other case, only the lever 70 can be turned against the force of the spring 71.

The tapered surface 65 of the stopper 60, as shown in the figure, is such that the diameter of the stopper decreases in the upward direction. Therefore, when the stopper 60 is moved upward from the position shown, a side edge of the lever 61 comes into contact with a large diameter part 74 of the stopper 60, resulting in that the suction mouth 16 shown in FIG. 1 is turned counterclockwise about the shaft 55 from the position shown.

In addition, in FIG. 1, an end part of the lever 61 substantially integral with the suction mouth 16 is connected by a rod 77 to an end of a cam lever 76 which is displaced by a cam 75. The cam lever 76 is oscillatable about a shaft 78, and a cam follower 79 is supported thereon through a shaft. The cam 75 is rotated in synchronism with the rotary plate (4 in FIG. 5) of the finding device by a driving mechanism (not shown), and the cam lever 76 is momentarily turned counterclockwise about the shaft 78 by a cam surface 75*a*.

The actions of the abovementioned mechanism will now be explained.

In FIGS. 1 and 2, it is assumed that the bobbins to be treated are of two kinds and the yarn layer diameter d2 of the bobbins X2 is larger than the yarn layer diameter d1 of the bobbins X1. When the bobbin X1 reaches the station D and the bobbin X2 reaches the station C, the bobbin diameter of the bobbin X1 has been previously detected at the station C, and the suction mouth 16 has been positioned at a position conforming to the diameter of the bobbin X1, so that the operation of finding the yarn end of the bobbin X1 by the suction through the opening part 15 is started immediately after the arrival of the bobbin X1 at the station D.

On the other hand, upon the arrival of the bobbin X2 at the station C, the yarn layer thereof presses the feeler 44, whereby the feeler 44 is turned clockwise about the shaft 43 against the spring 49 to the position indicated by the two-dotted line. The lever 45 integral with the feeler 44 and the lever 46 connected to the lever 45 through the spring 51 are also turned simultaneously to the positions 45*a* and 46*a* indicated by the two-dotted lines.

At this time, the rod 47 connected to the lever 46 is pulled in the direction of arrow 80 to cause the lever 70 in FIG. 2 to turn about the shaft 69 to the position 70 indicated by the two-dotted line. In this case, through the levers 67, 70 are connected by the spring 71, the lever 67 cannot be turned, since the lever 61 integral with the suction mouth is pressed against the stopper 60 in connection with the lever 67 by the spring 63; therefore, only the lever 70 is turned against the spring 71, and the pin 72 is brought to a position 72*a* separate from the side edge 73 of the lever 67. This condition may be said to be one in which the bobbin diameter of the bobbin located at the position of the station is stored, and the suction mouth 16 is moved in accordance with the stored bobbin diameter at the time of the subsequent one-pitch movement of the bobbins.

Namely, when the cam 75 is rotated in the direction of arrow 81 in conjunction with the one-pitch movement of the bobbins X1 and X2 after the yarn end finding operation for the bobbin X1 at the station D is finished, a projected part 75*a* momentarily turns the cam lever 76 to the position 76*a* indicated by the two-dotted line, through the cam follower 79. Accordingly, the lever 61 is caused through the rod 77 to turn counterclockwise together with the shaft 55 against the spring 63, to be separate from the stopper 60. At this moment, the lever 67 provided with the stopper as shown in FIG. 2 does not receive the pressing force of the lever 61 any longer, so that the lever 67 is moved by the tensile strength of the stretched spring 71 to such a position as to make contact with the pin 72*a* located at the two-dotted line position, resulting in that the stopper 60 is moved upward, and a part thereof on the large diameter part side of the tapered surface is moved up to the level of the lever 61. Subsequently, when the projected part 75*a* of the cam 75 shown in FIG. 1 comes off the cam follower position, the cam lever 76 and the rod 77 are moved in the direction of arrow 82 by the force of the spring 63, and the lever 61 comes into contact with the large diameter part 74 of the stopper 60, whereby the opening part 15 of the suction mouth 16 is retracted from the position for acting on the bobbin X1, and is positioned at a position spaced from the surface of the yarn layer on the bobbin X2 by the spacing S.

When the bobbin X2 is moved from the station C to the station D and the next bobbin X3 is moved to the station C, and if the bobbin diameter d1 of the bobbin X3 is smaller than that of the bobbin X2, the feeler at the position indicated by the two-dotted line 44*a* in FIG. 1 is pressed against the surface of the yarn layer on the bobbin X3 by the force of the spring 49, and the lever at the two-dotted line position 45*a* is turned counterclockwise to a position determined by the feeler 44*a* and the bobbin. At this time, though the rod 47 connected with the lever 46 by the spring 51 receives a force in the direction of arrow 83, since the lever 70 on the side of the station D at the other end of the rod 47 is previously positioned at the two-dotted line position 70*a* and the lever 61 is pressed against the stopper 60 by the force of the spring 63, the lever 70 is prevented from turning and, accordingly, only stretching of the spring 51 on the side of the station C occurs. Thus, the feeler 44 follows up the bobbin diameter of the bobbin at the position of the station to detect the bobbin diameter, and the detected bobbin diameter is stored by the spring 51, the lever 45 and the like.

After the yarn end finding operation for the bobbin X2 at the position of the station D is finished, the bobbins at the respective stations are moved one pitch, and when the lever 61 is once forcibly separated from the stopper 60 by the cam 75 rotated in synchronism with the movement and through the cam lever 76, the restricting force of the lever 70 disappears, and the spring 51 in the stretched state on the side of the station C contracts, whereby the rod 47 is moved in the direction of arrow 83 in FIG. 1. As a result, the stopper 60 is lowered through the rod 47 and the levers 70 and 67 in FIG. 2, a small diameter part 84 of the stopper 60 comes to a position facing the lever 61, and when the projected part 75*a* of the cam 75 comes beyond the position of the cam follower 79, and the lever 61 is again turned by the force of the spring 63 to the position for pressing against the stopper 60, whereby the suction mouth 16 integral with the lever 61, namely, the opening part 15, is positioned at a position spaced from the surface of the yarn layer on the bobbin X3 by the spacing S.

Where the displacement of the opening part 15 of the suction mouth 16 is set to be equal to the difference in the bobbin radius, the spacing between the surface of the yarn layer and the opening part 15 is constantly fixed, and the suction force for the yarn end becomes stable.

Accordingly, when the length of each of the various levers for transmitting the displacement of the feeler 44, as measured from the corresponding fulcrum, is set on the basis of the displacement of the feeler 44, it is possible to synchronize the moving amount of the opening part of the suction mouth with the displacement of the feeler 44.

Incidentally, it is necessary that the axes of the bobbins at the stations C and D be on the arc 86 of a circle having a center at the axis 85 of the rotary plate shown in FIG. 1. In this connection, it is convenient, for example, to provide members for positioning the lower and upper ends of the bobbin at each station, whereby the displacement of the feeler 44 and the spacing S between the opening part of the suction mouth and the surface of the yarn layer can accurately follow up the bobbin diameter.

In addition, to prevent unexpected movements of the feeler 44 during the movement of the bobbins,.the feeler 44 may be fixed during the movement of the bobbins. For instance, a member such as a brake shoe for urging the lever 45 in FIG. 2 upward by a spring force may be provided on the lower side of the lever 45 so that it can be moved in the vertical direction, with the pressing position and the spaced position of the member being moved by a cam and a cam lever, and the cam may be driven is synchronism with the driving of the rotary plate 4, whereby the feeler 44 can be fixed or released for appropriate periods of time.

Figure 3:
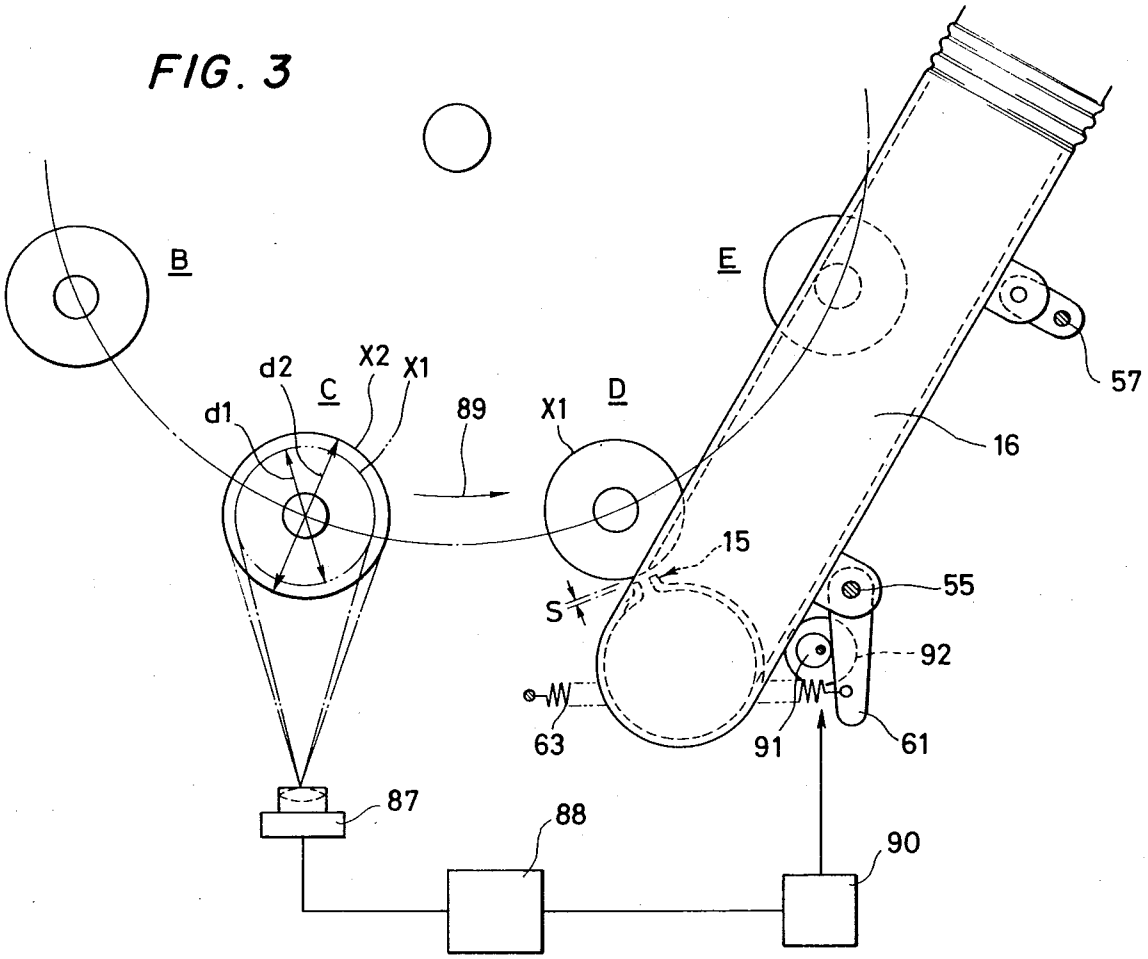
FIG. 3 is a general constructional view of another embodiment.

Although in the abovementioned working example the detection of the bobbin diameter is performed by a mechanical feeler, other means can also be used. FIG. 3 shows another working example.

In FIG. 3, the suction mouth 16 is supported so that it can be moved with shafts 55 and 57 as fulcrums and a lever 61 fixed to the shaft 55 is urged clockwise by a spring 63, as in the former working example. In this example, the bobbin diameter of the bobbin at the station C on the immediate upstream side of the yarn end finding station D is optically detected by an image sensor 87, and the moving amount of the opening part 15 of the suction mouth 16 is set or controlled according to the detection signal. An electrical signal obtained by the image sensor 87 is once stored in a memory in a controller 88, and in synchronism with the movement of the bobbin in the direction of arrow 89, a driving device 90 is driven by the stored signal, and a stopper 91 constituted of an eccentric cam is rotated a predetermined angle by a servo motor 92, whereby the contact position of the lever 61 and the stopper 91 is changed, and the position of the suction mouth 16 is changed. Thus, the spacing S is maintained to be constant irrespectively of variations in the bobbin diameter. In any case, the spacing S is several millimeters.

While a system in which the suction mouth as a whole is moved has been explained in each of the above working examples, another system may be contemplated in which only the yarn end suction opening part is formed separately from the main body of the suction mouth so that only the opening part can be moved relatively to the main body in the radial direction of the yarn layer, and only the opening part is moved in accordance with the kind of the bobbin by a moving mechanism similar to that in the former examples. With the latter system, the device can be made further compact.

As has been described above, in the present invention, the yarn end suction opening part of the suction mouth for leading out the yarn end on the surface of the yarn layer on a bobbin by the action of a suction airflow is moved on the basis of the difference in the yarn layer diameter of the bobbins to be treated, and, accordingly, the spacing between the opening part and the surface of the yarn layer can be constantly fixed, a stable suction force can be applied to the yarn end, and the system is particularly effective in the case of treating a variety of bobbins by a single yarn end finding device.

What is claimed is:

1. A device for finding a yarn end of a yarn layer on a spinning bobbin, comprising:

detecting means for detecting the diameter of said yarn layer;

a suction mouth movable relative to the surface of said yarn layer; and spacing means for moving said suction mouth to a position adjacent to and spaced from the surface of said yarn layer in response to the diameter detected by said detecting means;

wherein the position of said suction mouth relative to the surface of said yarn layer is controlled according to the diameter of said yarn layer.

2. A device as claimed in claim 1, further comprising:

a yarn end finding station; and a yarn detecting and cutting station having a bobbin location for positioning a bobbin thereat;

wherein said suction mouth comprises a suction pipe having:

a first slit extending across said yarn layer of a bobbin positioned at said yarn end finding station, and a second slit continuous with the first slit extending over said yarn detecting and cutting station.

3. A device as claimed in claim 1, wherein said means for moving the suction mouth includes:

a stopper mechanism for stopping movement of said suction mouth at a location determined by the position of the stopper mechanism; and movement means for moving said stopper mechanism;

wherein movement of said stopper mechanism causes displacement of the location where the movement of the suction mouth is stopped.

4. A device as claimed in claim 3, wherein said detecting means further comprises:

a movable feeler;

a means for urging the feeler toward said yarn layer;

a first lever, movable with said feeler; and a rod connected to said first lever;

where said first lever and said rod transmit a moving amount moved by said feeler to the stopper mechanism.

5. A device as claimed in claim 4, wherein said stopper mechanism comprises:

a movable stopper having a tapered surface;

a slide guide in which said movable stopper is movable; and a second lever connected to said movable stopper and said rod so as to move the stopper in response to movement of said feeler.

6. A device as claimed in claim 5, wherein said means for moving the suction mouth further includes:

a first shaft and a second shaft for movably supporting the suction mouth;

a third lever connected to said first shaft and positioned to abut said movable stopper; and a spring connected to the third lever for urging the suction mouth toward the yarn layer;

wherein the position of said movable stopper determines the position of said third lever, and said suction mouth.

7. A device as claimed in claim 6, further comprising:

a second rod engaged with said third lever;

a cam lever connected with said second rod; and a cam adapted to displace said cam lever, said second rod and said third lever, so as to separate said third lever from said movable stopper.

8. A device as claimed in claim 1, further including:

a first supporting shaft and a second supporting shaft for movably supporting said suction mouth;

a first abutting lever connected to said first supporting shaft;

a spring for urging said first abutting lever toward the yarn layer; and a stopper, constituted of an eccentric cam, adapted to abut said first abutting lever.

9. A device as claimed in claim 8, wherein said means for detecting the diameter of the yarn layer comprises:

an image sensor, for producing an electrical signal dependent on said diameter; and rotation means to rotate said stopper being responsive to said electrical signal;

where the rotation of said stopper causes a change in position of said suction mouth.

10. A yarn end finding device for finding a yarn end on the yarn layer of each of a plurality of spinning bobbins, comprising:

detecting means for detecting the diameter of the yarn layer of a respective bobbin;

suction mouth means spaced from the yarn layer for directing a suction force to the yarn layer;

positioning means responsive to the detecting means for adjusting the relative distance between the suction mouth means and the yarn layer;

whereby a substantially constant suction force is directed by the suction mouth means to the yarn layer of each of the spinning bobbins independent of the diameter of the yarn layer of the spinning bobbin.

11. A yarn end finding device for finding a yarn end on the yarn layer of each of a plurality of spinning bobbins, comprising:

detecting means for detecting the diameter of the yarn layer of a respective bobbin;

a suction mouth spaced from the yarn layer; and spacing means, responsive to the detecting means, for adjusting the relative distance between the suction mouth and the yarn layer;

wherein said spacing means maintains the relative distance between the suction mouth and the yarn layer of each of the spinning bobbins substantially constant independent of the diameter of the yarn layer.

12. A yarn end finding device as claimed in claim 11, wherein said spacing means comprises:

means for moving said suction mouth relative to the yarn layer.

13. A yarn end finding device for finding a yarn end on the yarn layer of each of a plurality of spinning bobbins, comprising:

suction mouth means, spaced apart from the yarn layer, for directing a suction force to the yarn layer;

detecting means for detecting the location of the yarn layer of a respective bobbin;

spacing means, responsive to the detecting means, for adjusting the relative distance between said suction mouth means and the yarn layer so as to maintain a substantially constant relative distance between said suction mouth means and the yarn layer on each of said spinning bobbins independent of the diameter of the yarn layer.

14. A method of finding a yarn end of a yarn layer on a spinning bobbin, said method comprising the steps of:

detecting the diameter of the yarn layer;

directing a suction force to the yarn layer through a suction mouth spaced from the yarn layer, adjusting the relative spacing between the suction mouth and the yarn layer in response to the detected diameter of the yarn layer, whereby the position of said suction mouth relative to the yarn layer is controlled according to the diameter of the yarn layer.

* * * * *